US007166205B2

(12) United States Patent
Kuo et al.

(10) Patent No.: US 7,166,205 B2
(45) Date of Patent: Jan. 23, 2007

(54) METHOD FOR PRODUCING HARD SURFACE, COLORED, ANODIZED ALUMINUM PARTS

(75) Inventors: Hong-Hsiang Kuo, Troy, MI (US); Yar-Ming Wang, Troy, MI (US); Joseph C. Simmer, Armada, MI (US); Hsai-Yin Lee, Troy, MI (US)

(73) Assignee: General Motors Corporation, Detroit, MI (US)

( * ) Notice: Subject to any disclaimer, the term of this patent is extended or adjusted under 35 U.S.C. 154(b) by 443 days.

(21) Appl. No.: 10/635,210

(22) Filed: Aug. 6, 2003

(65) Prior Publication Data

US 2005/0029115 A1 Feb. 10, 2005

(51) Int. Cl.

| | |
|---|---|
| ***C25D 11/18*** | (2006.01) |
| ***C25D 11/12*** | (2006.01) |
| ***C25D 11/08*** | (2006.01) |
| *B62D 29/00* | (2006.01) |

(52) U.S. Cl. ..... 205/174; 205/175; 205/324; 205/328

(58) Field of Classification Search ..... None
See application file for complete search history.

(56) References Cited

U.S. PATENT DOCUMENTS

| | | | | |
|---|---|---|---|---|
| 2,692,851 | A * | 10/1954 | Burrows | 205/148 |
| 4,606,796 | A * | 8/1986 | Hanazima et al. | 205/202 |
| 4,686,155 | A * | 8/1987 | Kilbane et al. | 428/653 |
| 5,472,788 | A * | 12/1995 | Benitez-Garriga | 205/174 |

* cited by examiner

*Primary Examiner*—Harry D. Wilkins, III
(74) *Attorney, Agent, or Firm*—Kathryn A. Marra

(57) ABSTRACT

The present invention uses a two-step anodizing process to produce a colored anodized coating on the surface of an aluminum part. In accordance with this invention, a thin hard anodized coating layer is first formed on the surface of the aluminum part and then growing a softer a clear anodized coating layer on the surface of the aluminum part underneath the hard coat layer. The soft coat is essentially colorless and suitable for color finishing. This invention drastically improves the wear resistance of the aluminum part while maintaining a desired amount of clarity for effective electrolytic coloring.

9 Claims, 1 Drawing Sheet

METHOD FOR PRODUCING HARD SURFACE, COLORED, ANODIZED ALUMINUM PARTS

TECHNICAL FIELD

This invention relates generally to anodizing aluminum for subsequent coloring. More specifically, this invention relates to a method of forming an anodized coating on an aluminum surface with a hard outer layer and clear intermediate layer. The clear intermediate layer is colored to provide a decorative aluminum surface protected from wear by the outer layer.

BACKGROUND OF THE INVENTION

Aluminum alloys are used in making sheet metal automotive body panels and other parts. In many such applications the aluminum part requires a decorative and wear resistant surface. Usually such aluminum parts are simply painted to match other surfaces on the vehicle. The painted aluminum surface is attractive and provides wear resistance that is comparable to other painted surfaces on the vehicle. Aluminum surfaces can also be anodized and the resulting oxide layer colored. But it has proven difficult to produce a colored anodized layer on an aluminum part that is both decorative for automotive applications and suitably wear resistant.

The state of the art is such that anodized surfaces that can be colored have not been resistant to wear or scratching. The clear, porous anodized layers that will reliably, reproducibly and uniformly take a coloring material (e.g., a pigment) are too soft for vehicle applications. But anodized coatings that are very hard are dark and are not receptive to coloring for vehicle surfaces.

Thus, it is an object of the present invention to provide a method of producing a wear resistant anodized surface on an aluminum alloy automotive body part that can suitably be colored.

SUMMARY OF THE INVENTION

This invention produces a two layer anodized coating on a surface of an aluminum article. The outer layer is relatively hard with relatively small vertical axial pores in the columnar crystals of aluminum oxide and is usually dark. This layer is formed first on the suitably cleaned and prepared aluminum surface. A clearer, softer, larger pore layer of aluminum oxide crystals is then grown from the aluminum substrate beneath the hard layer. It is this lower, or inner, anodized layer that is colored. Thus, as an example, the thickness of the hard anodized layer on a vehicle body panel may be about five microns and the thickness of the lower layer about ten microns. The inner layer is colored, for example, by known dyeing or electrolytic processes through the pores of the outer layer. In general the outer layer is not colored. Even though the hard layer is not clear, it is thin enough so the visual effect of the underlying colored layer is substantially retained, but thick enough to provide a suitable level of protection for that colored layer.

The first coating layer, which becomes the protective outer layer, is formed on a surface(s) of the aluminum part by a suitable hard coat anodizing method. For example, the surface of the part is prepared for anodizing, such as by cleaning and polishing. It can then be immersed in an aqueous sulfuric acid electrolyte bath and arranged as the anode for direct current anodization. Typically, the temperature of the bath is low relative to clear coat anodizing, for example, about 2° C. The electrolysis is conducted using known process parameters to form dense, hard aluminum oxide columns with relatively small vertically axial pores. For automotive body external applications, a hard coat thickness of about 5 to 7 microns is usually suitable.

After the hard anodized layer is formed, the aluminum part is immersed in a second anodizing bath for the formation of the softer, thicker clear layer. Again, an aqueous sulfuric acid electrolyte can be used. The part is arranged as an anode in the bath and the bath operated to grow columns of aluminum oxide crystals on and from the aluminum substrate. The electrolyte penetrates the pores of the hard layer under conditions that the softer aluminum oxide layer is formed. Typically the soft colorable layer is grown under the hard layer at a bath temperature close to ambient temperatures (e.g., 15–25° C.) in a direct current circuit. The thickness of the soft, clear anodized layer for automotive exterior body applications is suitably about 7 to 15 microns.

After the outer hard anodized layer and underlying clear anodized layer have been formed on the aluminum substrate, the aluminum part can be colored. For practical processing reasons it will usually be preferred to transport the coloring particles electrolytically into the larger pores of the aluminum oxide columns of the soft layer. However, dying and other coloring processes may be used.

The practice of this invention can, of course, be varied to obtain a combination of hard anodized layer and soft anodized layer thickness for different applications. For automotive body exterior applications it is preferred to have a relatively thin outer hard layer and a thicker soft layer for retaining sufficient coloring material for the desired decorative effect. Many different aluminum alloy compositions are considered for automotive applications and for other product applications. The alloying content of the aluminum workpiece can affect the growth and clarity of the anodized oxide columns. However, hard coat anodizing and clear coat anodizing practices are known although they haven't been used in combination as proposed in this invention. They can be adapted to achieve the objects of this invention. In this regard, there are many anodizing bath compositions that have been used or evaluated in anodizing operations. For most applications aqueous sulfuric acid baths (100 to 200 grams of acid per liter of electrolyte) can be used in the practice of this invention.

These and other objects and advantages of this invention will become apparent from a detailed description of a preferred embodiment that follows.

DESCRIPTION OF A PREFERRED EMBODIMENT

A purpose of this invention is to provide an aluminum article with a colored or decorative anodized surface that is wear resistant in situations to which decorative articles are sometimes exposed. This result is achieved by first forming a particularly hard, often dark, wear resistant anodized coating on the article and then growing a softer and clear anodized coating on the surface underneath the hard layer. Both the hard and soft coatings are porous and coloring particles are introduced through the pores of the hard coating and into the pores of the soft layer.

Figure 1:
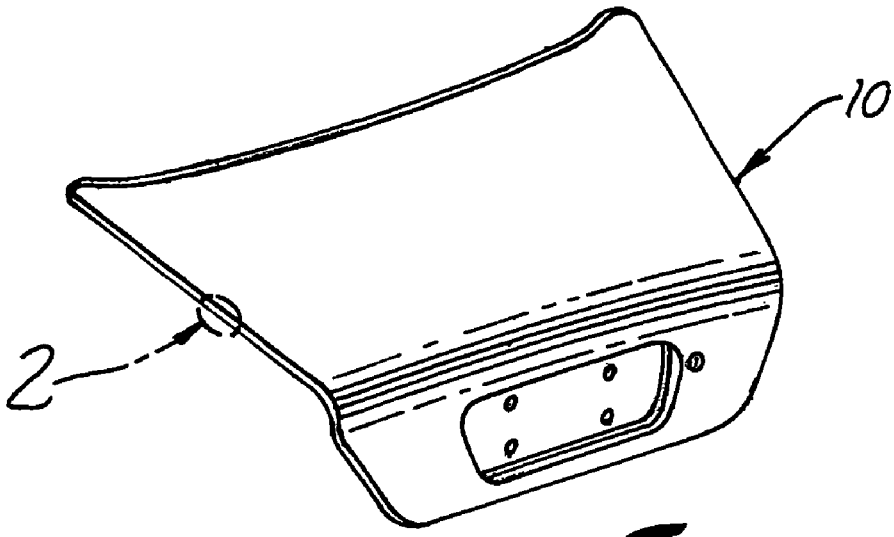
FIG. 1 is a perspective view of an aluminum alloy automobile deck lid outer panel as a representative article for anodizing and coloring by a practice of this invention.
Figure 2:
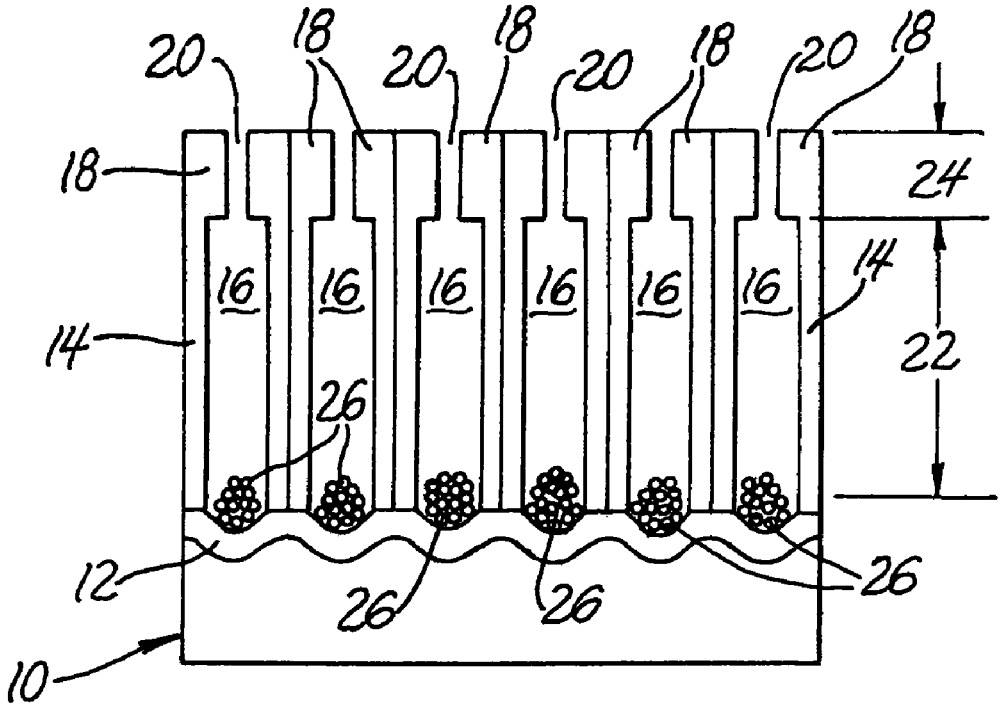
FIG. 2 represents an enlarged, conceptual, schematic, sectional view of the aluminum alloy panel of FIG. 1 having the two anodized layers formed thereon with coloring material in the coating.

FIG. 1 is a vehicle deck lid outer panel 10. Panel 10 is representative of an automotive body panel that can be anodized and colored in accordance with a preferred embodiment of this invention. FIG. 2 is a greatly enlarged schematic cross sectional view of a small portion of a surface 11 of panel 10. Obviously only a small portion of the surface of panel 10 is shown in FIG. 2.

The anodized surface illustrated in FIG. 2 comprises an aluminum oxide barrier layer 12 and a layer of closely spaced crystalline columns of clear and relatively soft aluminum oxide 14 with vertical axial pores 16. As has been stated and will be described in more detail below, the relatively soft aluminum oxide columns 14 are produced by a soft coat anodizing process, sometimes referred as Type II anodizing. Further, as viewed at the top of the FIG. 2 drawing, there is a different anodized layer of relatively hard crystalline columns of aluminum oxide 18 with pores 20. As will also be described in more detail below, the hard aluminum oxide columns 18 are produced by a hard coat anodizing process, sometimes referred to as Type III anodizing.

The anodized alumina layers shown in FIG. 2 are not necessarily drawn to scale. Thus, it will be helpful to discuss exemplary dimensions for the two separately formed anodized layers. The aluminum panel 10, or other article, can be formed of virtually any aluminum alloy or of "pure" aluminum. Anodizing practices for producing clear, colorable aluminum oxide layers may vary somewhat depending upon the composition of the aluminum substrate. But in accordance with this invention, the columnar crystals 14 of the clear anodic coating will typically be about 7–10 micrometers or more in thickness (dimension indicated at 22). The thickness of the barrier layer 12 is normally about 15 to 25 nanometers. The aluminum oxide columns 14 are typically polygonal in cross section with a diameter of about 25 to 45 nanometers. The diameter of the pores 16 of these relatively soft and clear aluminum oxide crystals 14 is typically about 9 to 20 nanometers. The hard coat layer represented by hard columnar aluminum oxide crystals 18, for use in this invention, is usually about 4 to 10 micrometers in thickness (dimension indicated at 24). The cross sectional diameter of these polygonal hard aluminum oxide crystals may be about the same as that of the softer columns 14. But the pores 20 of these hard aluminum oxide columns 18 are much smaller, usually only 1 to 2 nanometers in cross section. As stated, the hard layer crystals 18 are actually formed first so that their layer overlies the later formed soft clear anodized layer of crystals 14.

The invention is applicable to the coloring of any suitable aluminum alloy article. Such aluminum alloys are generally classified using a four-digit system based upon the principal alloying element. Suitable aluminum alloys are selected from these classified groups including copper containing aluminum alloys (Group 2000), aluminum-manganese alloys (Group 3000), aluminum-silicon alloys (Group 4000), aluminum-magnesium alloys (Group 5000), aluminum-magnesium-silicon alloys (Group 6000), and aluminum-zinc alloys (Group 7000). Automotive body parts are typically made from available aluminum alloys having properties that are suitable for forming and, now, for coloring. Body panels are often stamped or otherwise formed from AA 5xxx or 6xxx alloys.

The practice of the invention will be illustrated using sheet metal samples of AA5657, a magnesium-containing aluminum alloy having a cold rolled glossy finish. It is commonly used for trim pieces and decorative finishes. Also used were sheet metal samples of AA6111, a magnesium and silicon containing aluminum alloy with a duller finish. This alloy is commonly used in the stamping of hoods and lift gates.

In general, aluminum alloy parts intended to have a decorative finish require a smooth, clean surface for anodizing. Pretreatment of the aluminum article includes the removal of dirt, forming lubricant or other extraneous material that may inhibit or alter the anodizing process. The pretreatment stage includes washing the aluminum parts in an alkaline cleaning solution. The alkaline cleaning solution can include different sodium salts mixed with other surfactants, synthetic detergents, wetting agents and the like. The AA5657 and AA6111 sheet metal samples were cleaned in a solution of tri-sodium phosphate at a concentration of about 5 g/L. The temperature of the solution was about 60° C. for an immersion time of about 5 minutes. After cleaning, the aluminum alloy parts were removed from the cleaning solution. Then the specimens were rinsed in water for about 30 seconds.

After suitable cleaning, the AA6111 specimen was etched by immersion in a heated sodium hydroxide solution. Sheet metal specimens often have microscopic surface irregularities (protuberances) and the etching process chemically removes (dissolves) the most prominent high spots of aluminum metal with the concurrent evolution of hydrogen. Etching of the specimens levels out surface imperfections and leaves a smoother, semi-matted surface. In the case of AA6111 specimen, the etching step was done at an elevated temperature of about 60° C. for a time period of about 5 minutes and, thereafter, rinsed with water for about 30 seconds. For many aluminum alloys, the etching step is used to produce a suitable surface for anodizing. In the case of the AA5657 specimen, it had been cold rolled to a suitable bright finish and thus the etching step was not required.

After etching, the AA6111 samples were de-smutted (sometimes called deoxidized) for removal of residual intermetallics by dipping the specimens into a deoxidizing bath of nitric acid. When alkaline etching takes place, most of the inter-metallic particles present are not dissolved but remain on the surface of the alloy as a grayish "smut" type film. And the best way to remove the "smut" layer is to use a chemical bath. The desmutting process also provides the aluminum alloy with a clean surface protected by a uniform thin oxide film. The desmutting process for these samples was performed by immersing or dipping the aluminum parts into the nitric acid bath for 1 minute and then following that dip with a 30 second rinse with deionized water. After the desmutting/deoxidizing step, the samples were ready for anodizing.

In general, anodizing is an electrochemical surface conversion process performed in an acidic solution in which the surface of an anodic aluminum metal layer is electrochemically converted to a porous crystalline aluminum oxide layer during application of an electrical current, suitably a direct current. The current is applied using a suitable cathode and the workpieces as anodes. The electrolysis is completed between the cathode and the anode through a sulfuric acid electrolyte. As the direct current is applied, oxygen gas is evolved at the surface of the anodic workpiece permitting oxygen to react with the aluminum atoms at the surface of the anodic workpiece. A porous, crystalline, columnar aluminum oxide coating is formed and grows on the surface.

The method of the present invention produces a colored anodized coating on the surface of an aluminum alloy using a two step anodizing process applied in sequential order to produce two distinct anodic layers and then coloring by a subsequent coloring process. The first step of the anodizing process comprises producing a hard, relatively dark colored, anodized coating by a hard coating process. The second step of the anodizing process then produces a soft, relatively clear, anodized coating. The soft coated layer, although produced after the harder layer, is formed between the surface of the aluminum alloy and the hard coat layer. After anodizing, the aluminum alloy is then colored, preferably by an electrolytic coloring process.

Hard Coating of the AA5657 and AA6111 Samples

A sulfuric acid bath was used having a sulfuric acid concentration of 160 g/L, in which the samples were immersed. The bath temperature was maintained well below the room temperature value at about 2° C. A bath temperature below about 5° C. is generally suitable. A direct current was applied to the sulfuric acid bath with a voltage of about 30V for a period of time determined by the desired thickness of the hard coat. The effects of increasing coating time will be described below. Thereafter, the direct current was stopped and the samples were extracted from the sulfuric acid bath and rinsed for 30 seconds using deionized water. The anodized layer was characterized by dense porous crystalline columns of aluminum oxide. The aluminum oxide crystals were polygonal in cross-section, generally hexagonal. They had diameters of about 25 to 45 nm and axial pores about 1–2 nm in diameter. The thickness of the layer, the height of the columnar crystals, depended on the anodizing time as follows.

The thickness of the hard coat layer increases with longer anodizing times, as well as with higher anodizing voltages. The coating thicknesses (H) versus hard coating (HC) anodizing time, measured in microns, for both the AA6111 and AA5657 alloys tested are shown in Table 1. The hard anodic layer was produced using a sulfuric acid bath concentration of 160 g/L, voltage of 30V, and a temperature of 2° C.

TABLE 1

| HC Anodizing Time (minutes) | H Coating Thickness (microns) AA6111 | H Coating Thickness (microns) AA5657 |
|---|---|---|
| 0 | 0 | 0 |
| 5 | 7.34 | 17.04 |
| 10 | 16.29 | 23.34 |
| 15 | 28.03 | 52.09 |
| 20 | 39.46 | 60.94 |
| 25 | 42.54 | 61.67 |

The Table 1 data shows that longer cold anodizing times produce thicker layers of the hard crystals of aluminum oxide. However, thicker layers of the fine, porous crystals inhibit the rate of further growth. Before evaluating the nature of this hard crystalline layer, the formation of the underlying clear layer will be illustrated.

Clear Coating of the AA5657 and AA6111 Samples

The clear and softer coating of porous aluminum oxide crystals, which is essentially colorless, is formed by immersing the aluminum alloy specimens in an electrolytic solution of sulfuric acid having a sulfuric acid concentration of 160 g/L at ambient temperature (e.g., suitably above 15° C. and preferably about 20–25° C.) and passing a direct current through the bath at a voltage of about 16V. The goal was to produce a clear coat layer having a thickness of about 7–10 micrometers. It was determined that this could be accomplished by electrolysis in the sulfuric acid bath for about 25 minutes. The specimens were then rinsed in deionized water for about 30 seconds. The aluminum oxide crystals were polygonal in cross-section, generally hexagonal. They had diameters of about 25 to 45 nm. The pore size of the soft coating is larger than for the hard coat. In these specimens, the soft coated layer has pores with a diametric size of about 10 to 20 nanometers.

The rate of growth of the soft coat is dependent upon the thickness of hard coat layer. The coating thickness of the soft coat, measured in microns, for both the AA5657 and AA6111 alloys tested are shown in Table 2. The resulting soft anodic layers were produced in 25 minutes using a sulfuric acid bath concentration of 160 g/L, voltage of 16V, and a temperature of about 25° C.

TABLE 2

| HC Anodizing Time (minutes) | S Coating Thickness (microns) AA6111 | S Coating Thickness (microns) AA5657 |
|---|---|---|
| 0 | 7.80 | 13.92 |
| 5 | 7.67 | 10.50 |
| 10 | 6.33 | 9.92 |
| 15 | 6.39 | 9.20 |
| 20 | 7.85 | 5.91 |
| 25 | 5.91 | 4.17 |

The formation of the clear layer of aluminum oxide columns is accomplished by electrolytic action through the thickness of the small pore hard layer. Accordingly, it is seen that the thickness of the clear coat that can be formed in a fixed anodizing period, here 25 minutes, decreases with thicker hard layers. In general, the anodic coat thickness, as measured on sectioned samples, decreases with increasing hard coating (HC) time. This evaluation is true for the AA5657 alloy, and, although the thickness of the AA6111 alloy over hard coat time varies slightly, the trend observed is essentially the same for the AA6111 alloy as well.

Thus this invention is practiced to balance the thicknesses of the respective hard and clear layers to obtain a desired balance of wear resistance and color properties. As will be illustrated below, suitable hardness for most decorative applications such as automotive body panels is obtained by thin layers, 4–10 micrometers, of the hard coat.

Wear Resistance of the AA5657 and AA6111 Samples

The hard coated layer markedly contributes to the wear resistance of the aluminum alloy part. The wear resistance of the samples was measured by an abrasion test which produced a wear index. The abrasion test is performed using a wheel having an abrasive face (e.g., a strip of silicon carbide coated paper with a meshed surface) on one side. The aluminum alloy is clamped to a surface, such as a table, and the abrasive faced wheel is pressed against it. The force applied to the wheel to press it against the oxide layer of the aluminum alloy part is generally about 4 Newtons. The wheel is moved back and forth across the oxide to abrade a uniform track about 12 mm wide and 30 mm long. Then the wheel is rotated about 1 degree and another track is created. The degree of wear is measured either as the loss of thickness produced in the wear track or the loss of mass of the oxide per completed cycle of the abrasive test and is recorded in units of micro-grams per cycle.

Samples were prepared having hard coating times increasing from zero to 25 minutes in five minute increments. Each sample had a clear coat applied for 25 minutes, but the thickness of the clear coat could vary, as illustrated above, depending on the previously formed, if any, hard coat. In Table 3, the wear index data for the AA5657 and AA6111 samples at various hard coating times are shown.

TABLE 3

| HC Anodizing Time (minutes) | Wear Index (μg removed/cycle) for AA6111 | Wear Index (μg removed/cycle) for AA5657 |
|---|---|---|
| 0 | 2.67 | 2.20 |
| 5 | 1.31 | 1.34 |
| 10 | 1.66 | 1.27 |
| 15 | 2.03 | 1.58 |
| 20 | 2.21 | 1.19 |
| 25 | 1.95 | 2.04 |

At a hard coat anodizing time of 0 minutes, only the soft coat exists and the measured wear index is the value for the soft coat. Thus, wear indices over 2 micrograms per cycle represent the inadequate hardness of the soft coating for automotive applications. A lower wear index shows that the hard coated aluminum alloy specimens are more wear resistant. Such improved wear resistance over the clear coat is achieved with hard coating times of between 5 and 10 minutes. Actually hard coat thicknesses of about 4–10 micrometers provide adequate wear resistance over a clear anodized coating for most automotive applications.

Electrolytic Coloring of the Samples

It is desired that the soft coated layer be clear so that coloring by a subsequent coloring process will produce suitable hues that match other preformed aluminum body parts. So, high deviations from clearness of the soft coated layer will create greater the difficulties in achieving a desired color. When the aluminum alloy is colored, colored particles are deposited into the pores of the soft coat layer. Since the soft coat is clear and the hard coat is relatively thin, the color from the colored particles is able to scatter the incoming light through the dual anodic layers, thus exhibiting a strong colored finish displayed on the aluminum surface.

The specific coloring process of the present invention is done by electrolytic coloring, though other coloring processes can also be used. In electrolytic coloring an acidic electrolyte containing a dissolved metal salt is used. The electrolyte penetrates the pores of the layer to be colored. In the practice of this invention, the electrolyte flows through the small pores of the hard layer and into the larger pores of the clear layer. Color is imparted to the oxide layer by electrolytic deposition of reduced metal particles in the larger pores of the clear oxide layer.

The deposition of very small metal particles is affected by the application of alternating current to a metal salt solution and the metal salt is reduced during the cathodic part of the cycle close to the aluminum workpiece. As shown in FIG. 2, particles 26 are deposited in the pores 16 of the soft coat crystals 14. Metal salt solutions that may be used for the electrolysis coloring process include, but are not limited to, aqueous solutions of tin, cobalt, nickel, copper, and the like.

In the present invention, the AA5657 and AA6111 samples were colored in a tin sulfate solution. The actual electrolytic coloring process comprises three steps. The aluminum alloy part is immersed and soaked in the tin sulfate solution where the electrolyte penetrates the pores of the anodized coatings on the aluminum part for a time period of 1 minute. This soaking process is known as dwell time. Then the aluminum part is pretreated for 1 minute by subjecting the part to 8V of direct current. This pretreatment stage is used to activate the surface of the aluminum for coloring. Then coloring is done by applying a 60 Hz alternating current from +4V to −9 V for a time period of 15 seconds.

The quality of color produced on the aluminum alloy was determined by measuring color values using a Minolta colorimeter. The color was evaluated in terms of L*, a* and b* values of a colorimetric system, where L* is the lightness value, a* is the degree of green to redness color value, and b* is the degree of blue to yellowish value. As shown in Table 4, the color values as a function of hard coating time are provided.

TABLE 4

| HC Time | AA 6111 | | | AA 5657 | | |
|---|---|---|---|---|---|---|
| (min.) | L* | a* | b* | L* | a* | b* |
| 0 | 66.07 | 0.55 | 17.84 | 72.01 | 0.92 | 20.48 |
| 5 | 65.22 | −0.22 | 14.6 | 67.47 | 0.9 | 18.3 |
| 10 | 65.73 | −0.27 | 13.41 | 59.93 | 1.17 | 17.23 |
| 15 | 64.63 | −0.15 | 11.78 | 58.41 | 1.72 | 19.41 |
| 20 | 60.06 | 0.09 | 11.5 | 54.9 | 1.87 | 18.59 |
| 25 | 62.31 | −0.02 | 10.95 | 47.94 | 2.64 | 18 |

The color values in Table 4 measure the characteristics of the color transmitted through the anodic layers on the colored samples. The values of L*, a* and b* for the samples with no hard coat (zero hard coat time) represent the color of the tin particles with a 20 micrometer thick clear coat on the samples without any influence of a hard coat layer. Decreases in the L* variable for hard coated samples represent a decrease in the lightness of the color. The color is lighter for a higher value, where a value of 100 is lightest (i.e., white). For both the AA5657 and AA6111 the aluminum alloys, the color gets darker over longer hard coating times. In these samples, thin hard coat layers, less than 5 minutes coating time, provide good wear resistance without unduly darkening the color.

Other variables were measured while testing the color of the finished aluminum alloy part. The b* value was measured where a positive (+) b value indicates a color change toward yellow and a negative (−) b value indicates a color change toward blue. Likewise, the a* value was measured where a positive (+) a value indicates a color change toward red and a negative (−) a value indicates a color change toward green. As seen from Table 4, the color impact of the hard coat on the AA6111 alloy is mostly on the b* value, which indicates that the color became slightly less yellow and more blue with increasing hard coat time and thickness. Again, with longer hard coating times, the darkness of the hard coat will cause the resultant color to be darker.

For the AA5657 alloy, slight changes in the a* and b* values are noticeable, however, the AA5657 alloy is mostly impacted by decreasing L* values as hard coat time increases, thereby indicating a darker color with increasing hard coat time and thickness. The two-step anodizing process of the present invention produces better coloring of aluminum alloy parts as evident from the color values shown above.

Post Color Treatment

After coloring, the dual-layered anodic coatings are preferably sealed to enhance corrosion resistance and lock in the color. Thus, after the coloring process is complete, the aluminum alloy samples were then subjected to a two step sealing process. As a first step, the samples were subjected to a cold sealing process. The process of cold sealing is based on dipping solutions that contain fluoride compounds in the presence of nickel salts and often in a water-alcohol mixture. The water-alcohol solvent reportedly lowers the solubility of the salts and facilitates precipitation of the salts within the pores of the anodic film. The cold sealing temperature is about 30° C. and the sealing process is continued for a time period of about 15 minutes. Then the aluminum alloy is subjected to a second sealing step. The second sealing step includes subjecting the aluminum alloy to a hot water sealing process. In the hot sealing process of the present invention, the coated aluminum alloy is immersed in hot water at a temperature of 70° C. for a time period of about 15 minutes.

The process of the present invention provides a means for balancing wear resistance and colorability of anodized parts. The invention can be practiced to significantly improve wear resistance while retaining color in anodized aluminum workpieces. The invention is especially useful in automotive applications. But in any application a hard coat thickness can be selected for improvement in wear resistance, while still forming a suitable clear coat layer for electrolytic coloring. Electrolytic coloring processes can be controlled to produce different colors using the same metal salts. Coloring can also be done by other means, such as dyeing or interference coloring. Interference coloring is a variation of electrolytic coloring in which the pores of the colored anodized layer are electrolytically enlarged before the coloring metal particles are deposited. The result is the light rays reflected from the particles experience optical interference to produce a resultant reproducible color. Furthermore, in all coloring processes, the thickness of the hard coat layer is managed to preserve color brightness and hue.

While the invention has been described in terms of a preferred teaching, it is not intended to be limited to that description, but rather only to the extent of the following claims.

The invetion claimed is:

1. A method of making a colored anodized aluminum article with a hard anodized surface, said method comprising:

forming a hard anodized layer on a surface of said aluminum article, said anodized layer having pores and a thickness in the range of about 4 to 10 microns;

forming a clear anodized layer on the surface of said article under said hard anodized layer, said clear anodized layer having pores larger than the pores of said hard anodized layer and said clear anodized layer having a thickness of 7 microns or greater; and depositing colored particles into the pores of said clear anodized coating to color said aluminum article.

2. The method as recited in claim 1 where the thickness of said hard layer is 4 to 6 microns and the thickness of said clear layer is 10 to 15 microns.

3. The method of making a colored anodized aluminum article with a hard anodized surface layer as recited in claim 1 comprising forming said hard layer by anodizing said aluminum article in a first aqueous sulfuric acid bath at a bath temperature below 5° C.

4. The method of making a colored anodized aluminum article with a hard anodized surface as recited in claim 1 comprising forming said clear layer by anodizing said aluminum article in a second aqueous sulfuric acid bath at a bath temperature above 15° C.

5. A method of making a colored anodized aluminum article with a hard anodized surface, said method comprising:

forming a hard anodized layer on a surface of said aluminum article by anodizing said surface in a first sulfuric acid bath using a direct current through said first bath and a bath temperature below 5° C., said hard anodized layer having pores and the thickness of said hard anodized layer being in the range of about 4 to 10 microns;

forming a clear anodized layer on the surface of said aluminum article by anodizing said surface in a second sulfuric acid bath using a direct current through said bath and a bath temperature of above 15° C., said clear anodized layer having pores larger than the pores of the hard anodized layer and the thickness of said clear anodized layer being above 7 microns; and coloring said aluminum article by depositing colored particles into the pores of said clear anodized layer.

6. The method as recited in claim 1 comprising immersing said aluminum article with its said porous hard anodized layer and said porous clear anodized layer in an aqueous acid bath comprising a salt of one or more metals and electrolytically depositing particles of said metal from said bath into the pores of said clear anodized layer.

7. The method as recited in claim 6 comprising electrolytically coloring the aluminum part using a tin sulfate solution.

8. The method as recited in claim 5 comprising immersing said aluminum article with its said porous hard anodized layer and said porous clear anodized layer in an aqueous acid bath comprising a salt of one or more metals and electrolytically depositing particles of said metal from said bath into the pores of said clear anodized layer.

9. The method as recited in claim 8 comprising electrolytically coloring the aluminum part using a tin sulfate solution.

* * * * *